US006192719B1

(12) United States Patent
Stukas et al.

(10) Patent No.: US 6,192,719 B1
(45) Date of Patent: Feb. 27, 2001

(54) SNOWBOARD LOCKING DEVICE

(76) Inventors: Alfred A. Stukas, 303 Wyndale Rd., Rochester, NY (US) 14617; Dante DiProsa, 56 Charrington Rd., Rochester, NY (US) 14609; Josef Neubauer, 19 Clark St., Naples, NY (US) 14512

( * ) Notice: Subject to any disclaimer, the term of this patent is extended or adjusted under 35 U.S.C. 154(b) by 0 days.

(21) Appl. No.: 09/449,814

(22) Filed: Nov. 26, 1999

Related U.S. Application Data

(63) Continuation-in-part of application No. 09/231,269, filed on Jan. 15, 1999.

(51) Int. Cl.[7] ..... E05B 73/00
(52) U.S. Cl. ..... 70/18; 70/18; 70/30; 70/58
(58) Field of Search ..... 70/18, 30, 49, 70/58; 280/14.2, 814

(56) References Cited

U.S. PATENT DOCUMENTS 3,670,535 * 6/1972 Stettner et al. ..... 70/58
3,714,803 * 2/1973 Chenenko ..... 70/58
3,727,934 * 4/1973 Averbook et al. ..... 70/58 X
4,398,403 * 8/1983 Menick ..... 70/18 X
4,573,332 * 3/1986 Ma ..... 70/30
5,063,762 * 11/1991 Vandeweghe ..... 70/30
5,306,046 * 4/1994 Stanley ..... 70/58 X
5,531,082 * 7/1996 Wolk et al. ..... 70/18 X

* cited by examiner

*Primary Examiner*—Lloyd A. Gall
(74) *Attorney, Agent, or Firm*—Howard J. Greenwald

(57) ABSTRACT

A snowboard assembly containing a snowboard attached to a locking device. The locking device is contained within an enclosure, which is attached to the snowboard. The enclosure contains a base hingeably attached to a cover; the cover and base may be readily connected to and disconnected from each other. The locking device is inclined with respect to the base to afford ready visibility and easy access. A cable is connected to the locking device and is adapted to be connected to a post or other secure structure.

12 Claims, 10 Drawing Sheets

SNOWBOARD LOCKING DEVICE

CROSS-REFERENCE TO RELATED PATENT APPLICATION

This application is a continuation-in-part of applicants' copending patent application U.S. Ser. No. 09/231,269, filed on Jan. 15, 1999.

FIELD OF THE INVENTION

A snowboard assembly comprised of a snowboard connected to a locking device.

BACKGROUND OF THE INVENTION

Retractable locking assemblies for securing equipment such as ski poles, skis, and the like are well known. Thus, by way of illustration, U.S. Pat. No. 5,063,762 of Catherine M. Vanderweghe discloses a locking assembly external to, and mounted on, a portable or riding device.

The locking assembly described in the Vanderweghe patent is less than ideal. In the first place, it is rather cumbersome to use, requiring locking structure on each of two separate ski poles. Furthermore, because it involves the digital manipulation of several small parts, such as a rewind button 14 and a retractable cover 16, it is often difficult to manipulate by one whose fingers are numbed.

To the best of applicants' knowledge, no one in the prior art has provided a snowboard assembly comprised of a locking device which easy to use, relatively durable and reliable, and attractive.

SUMMARY OF THE INVENTION

In accordance with the invention, there is provided a snowboard assembly comprised of a snowboard attached to a locking assembly, wherein the locking assembly is comprised of a case attached to said snowboard, and a locking assembly disposed within said case.

BRIEF DESCRIPTION OF THE DRAWINGS

The invention will be described by reference to the specification and to the enclosed drawings, in which like reference numerals refer to like elements, and in which.

DESCRIPTION OF THE PREFERRED EMBODIMENTS

In the first portion of this specification, reference will be made to a locking assembly 10 which can be used with one or more ski poles 16 and 18. In the second portion of this specification, reference will be made to a locking assembly 100 which is attached to a snowboard 102.

Figure 1:
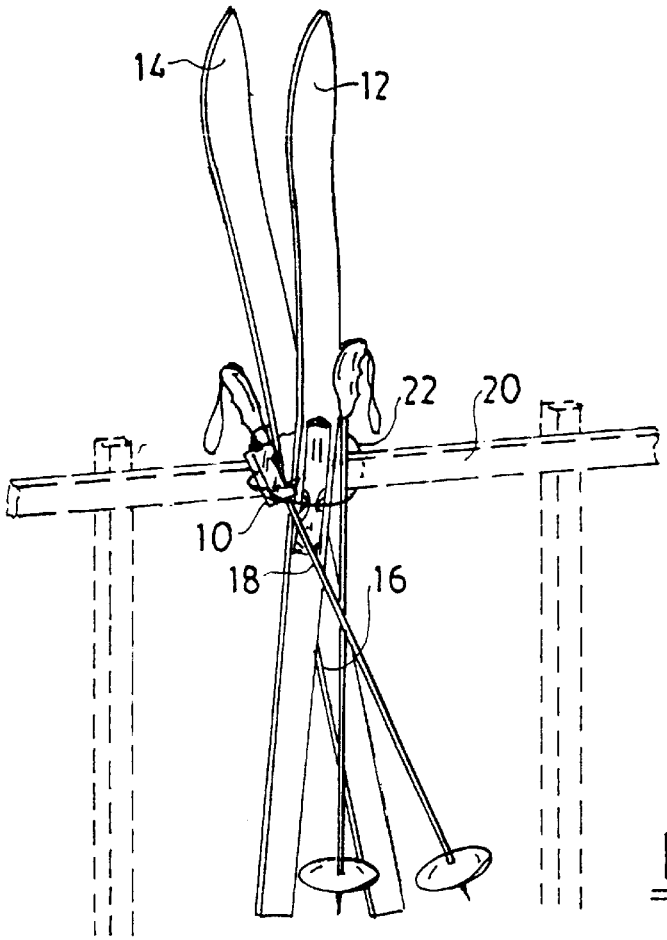
FIG. 1 is a perspective view of one preferred locking device of this invention securing two ski poles and two skis to a stand.

FIG. 1 is a perspective view of a locking assembly 10 which, in the preferred embodiment depicted, is being used to secure skis 12 and 14 and ski poles 16 and 18 to stand 20. In the preferred embodiment depicted, locking assembly 10 is attached to ski pole 18, and a retractable cable 22 from locking assembly 10 extends from locking assembly 10, around ski pole 18, ski 12, ski pole 16, stand 20, and ski 14, and then back to the locking assembly 10, wherein it is secured.

Figure 2:
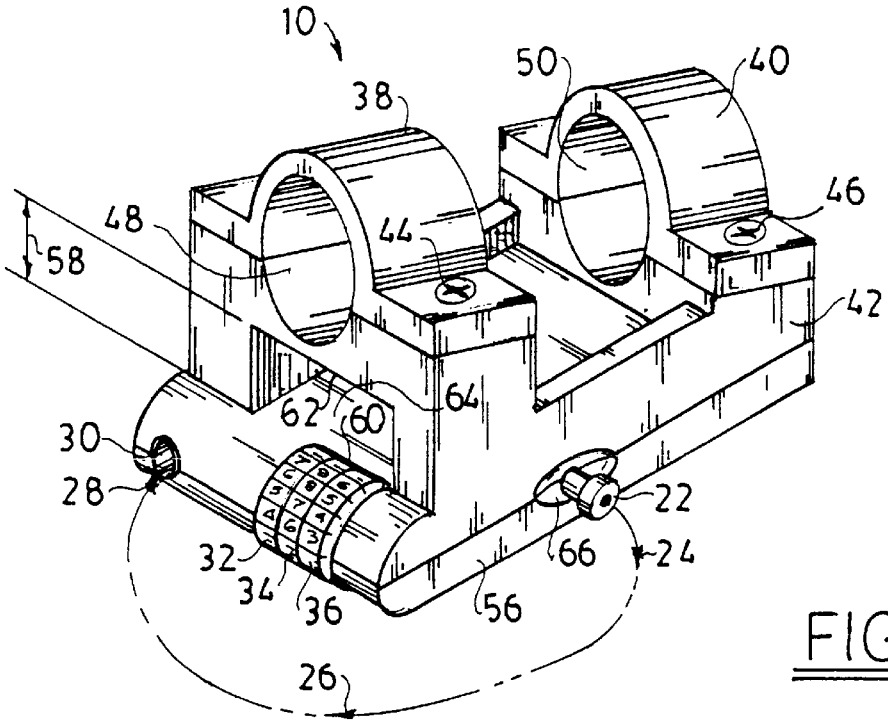
FIG. 2 is a perspective view of the locking device of FIG. 1.

FIG. 2 is a perspective view of locking assembly 10. It will be seen that retractable cable 22 may be extended in the direction of arrows 24, 26, and 28 and secured within keyhole orifice 30. The skis 12 and 14, the ski poles 16 and 18, and the stand 20 which the cable 22 is wrapped around have been omitted from FIG. 2 for the sake of simplicity of representation. It will be understood, however, that cable 22 preferably, when fully extended, is from about 1 to about 3 feet long and, more preferably, from about 20 to about 28 inches.

One may use any cable in the locking assembly 10 that will serve the desired function. Thus, as used in this specification, the term cable includes cables made from metal materials, elastomeric materials, and any other materials commonly used in industry exhibiting the traits of strength of flexibility. The preferred cable material is a braided metallic structure.

Referring again to FIG. 2, once the cable 22 has been secured within keyhole 30, it is lockably secured therein and only can be removed upon the alignment of the proper combination numbers in tumblers 32, 34, and 36.

One may use any conventional cable lock with a retractable cable for the assembly depicted in FIG. 2. Thus, by way of illustration and not limitation, one may use one or more of the assemblies disclosed in U.S. Pat. Nos. 5,063,762, 4,543,806 (retractable cable lock), U.S. Pat. No. 3,950,972 (lock with retractable cable), U.S. Pat. No. 3,906,815

(retractable cable assembly and lock), U.S. Pat. No. D272, 986 (combination lock with retractable cable), and the like. The disclosure of each of these United States patents is hereby incorporated by reference into this specification.

Combination locks with retractable cables are readily commercially available and may be purchased, e.g., as a "RECOILER" lock, manufactured by the Ski Tote U.S.A. of 161 Plaza LaVista, Camarillo, Calif. 93010. Similar ski locks may be purchased under the name of "KRYPTONITE."

In one embodiment, the combination lock with retractable cable is manufactured by the Sinox Company of Taiwan and sold as part number PL966.

Referring again to FIG. 2, and in the preferred embodiment therein, it will be seen that locking assembly 10 is comprised of a first bracket 38 and a second bracket 40, each of which is removably attached to body 42. In the embodiment depicted, the brackets 38 and 40 are removably attached by means of screws 44 and 46, and also by means of other screws (not shown in FIG. 1).

Referring again to FIG. 2, and in the preferred embodiment depicted, it will be seen that first bracket 38 defines an orifice 48, and the second bracket 40 defines an orifice 50. The orifices 48 and 50 define an angled path for a ski pole. Thus, referring to FIG. 4, when a line 52 is drawn through the center of orifices 48 and 50, it will preferably form an angle 54 with the base 56 of the locking device 10 of from about 8 to about 15 degrees and, more preferably, from about 9 to about 12 degrees. Thus, the ski pole (not shown in FIG. 2) disposed within orifices 48 and 50 diverges away from tumblers 32, 34, and 36 and thus gives one more ready access thereto. Additionally, it is preferred that the distance 58 between the top 60 of tumblers 32, 34, and 36 and the bottom 62 of notch 64 be at least about 0.25 inches and, more preferably, is from about 0.3 to 0.65 inches.

In another embodiment, not shown, the first bracket 38 and the second bracket 40 are combined into one bracket(not shown).

It is preferred that the body 42 of the locking assembly 10, and the brackets 38 and 40, consist essentially of plastic material. In one preferred embodiment, the plastic material used is a polyester, and most preferably a elastomeric material which consists essentially of polyester. By way of illustration and not limitation, one suitable polyester elastomer is sold by the E.I. duPont deNemours Company of Wilmington, Del. as ST801.

Figure 3:
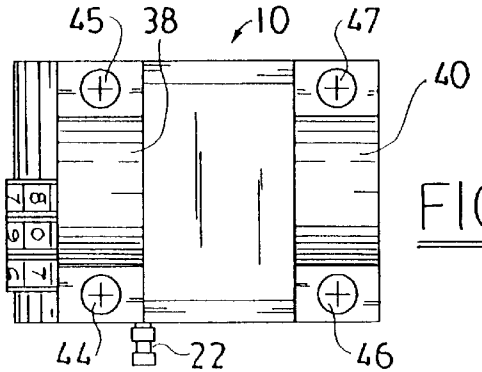
FIG. 3 is top view of the locking device of FIG. 1.

FIG. 3 is a top view of locking assembly 10, illustrating how screws 44, 45, 46, and 47 secure the brackets 38 and 40. In one preferred embodiment, screws 44, 45, 46, and 47 are substantially rust-proof screws such as those which are coated with "black oxide 632". Alternatively, or additionally, one may use stainless steel screws.

Figure 4:
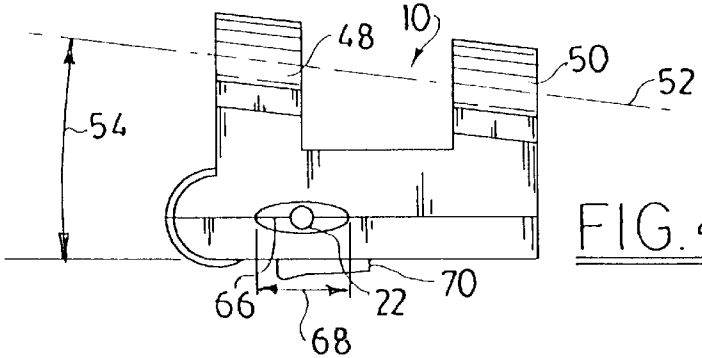
FIG. 4 is a side view of the locking device of FIG. 1.
Figure 5:
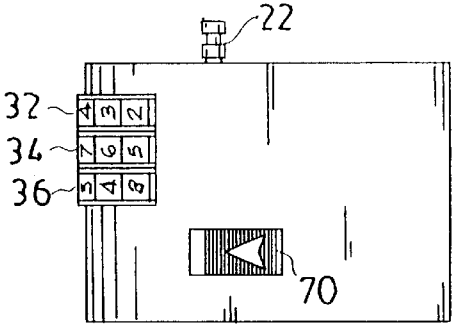
FIG. 5 is bottom view of the locking device of FIG. 1.
Figure 6:
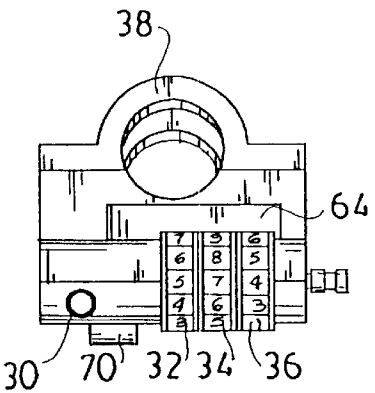
FIG. 6 is a front view of the locking device of FIG. 1.
Figure 7:
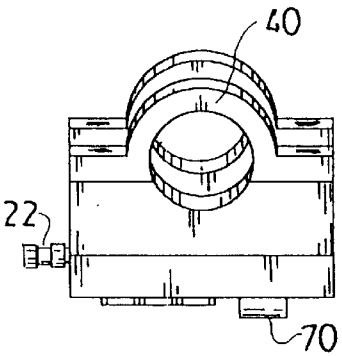
FIG. 7 is a back view of the locking device of FIG. 1.

FIG. 4 is a side view of the locking device 10. In the preferred embodiment depicted in FIG. 4,it will be seen that cable 22 is disposed within a notch 66 which preferably has a length 68 of at least about 0.7 inches and a height of at least about 0.3" to allow ready access to the cable 22. In one embodiment, the notch 66 may be as large as, e.g., 1.0" by about 0.5".

Referring again to FIG. 4, it will be seen that device 10 is comprised of a button 70 which, when depressed, will release the locking mechanism (not shown in FIG. 4) and, additionally, will release the tension on the cable 22.

Figure 8:
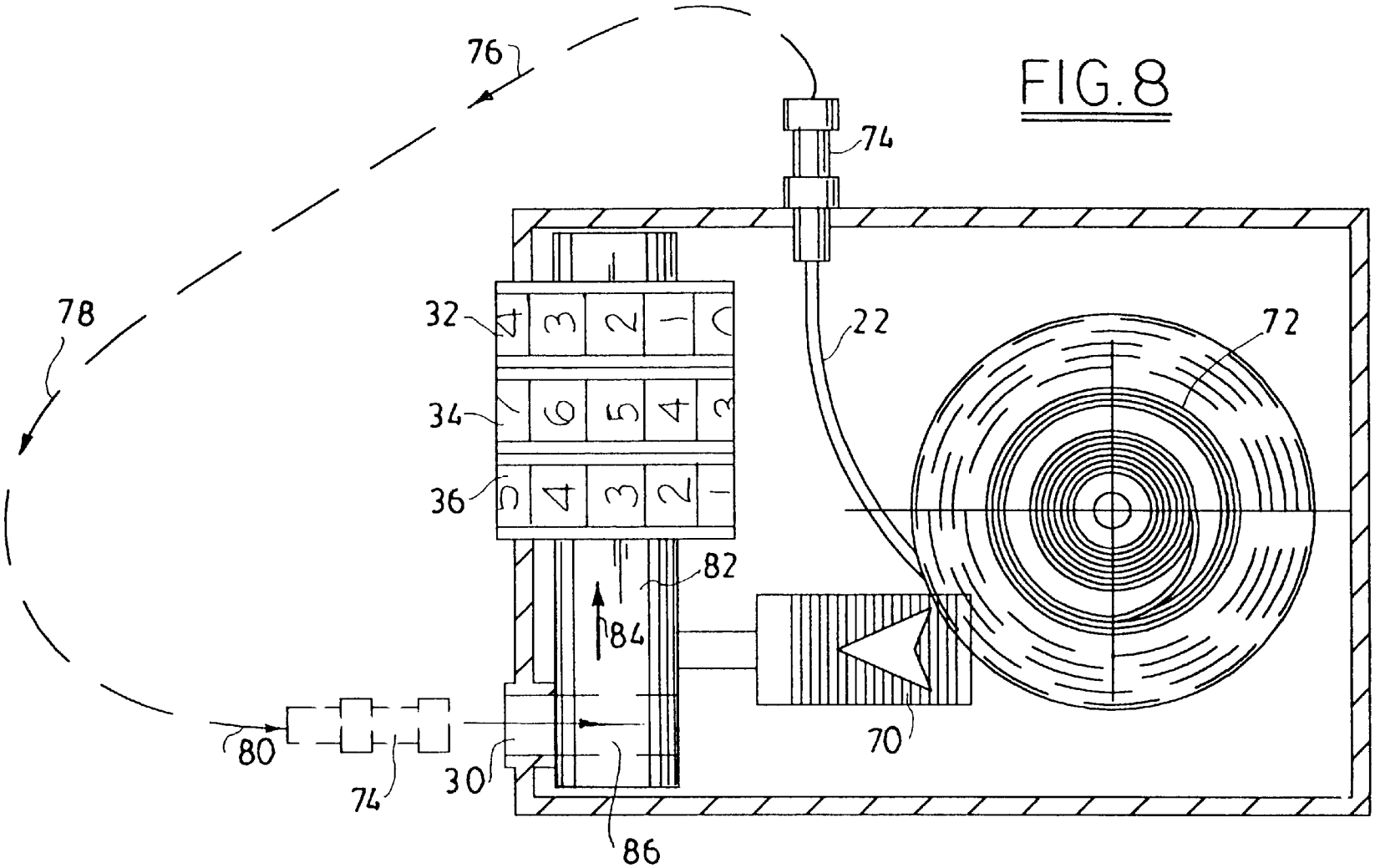
FIG. 8 is a schematic view of the interior of the locking device of FIG. 1.

FIG. 8 is a schematic view of one preferred locking mechanism. Referring to FIG. 8, it will be seen that cable 22 is wound around spring-loaded reel assembly. Cable locks with spring-loaded reel assemblies are well known to those skilled in the art and are described, e.g., in U.S. Pat. No. 5,653,467 (spring loaded reel with gear lock), U.S. Pat. Nos. 4,566,198, 4,404,822 (cable lock with spring loaded reel), U.S. Pat. No. 4,086,795 (cable lock with spring loaded reel), and the like. The disclosure of each of these United States patents is hereby incorporated by reference into this specification.

Referring again to FIG. 8, it will be seen that cable 22 is equipped with a locking tab 74 which may be withdrawn in the direction of arrows 76, 78, and 80 and removably locked within keyhole orifice 30. Once so locked, it may be disengaged when release button 70 is depressed.

In the mechanism depicted in FIG. 8, when button 70 is depressed, it will cause locking cylinder 82 to travel in the direction of arrow 84, thereby aligning orifice 30 with locking tab 74 and allowing their engagement. This type of locking cylinder arrangement, and similar arrangements, are well known to those skilled in the art and are described, e.g., in U.S. Pat. Nos. 5,855,129, 5,472,313, 5,288,210, 5,275, 534, 5,236,302, and the like. The disclosure of each of these United States patents is hereby incorporated by reference into this specification.

Figure 9:
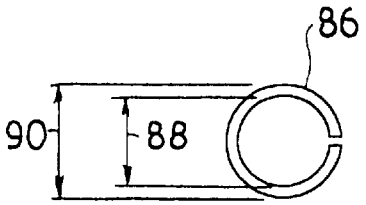
FIG. 9 a front view of a shim disposed within the brackets of the locking device of FIG. 1.
Figure 10:
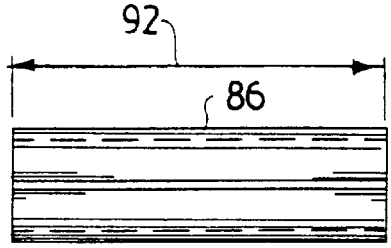
FIG. 10 is side view of the shim of FIG. 9.

FIG. 9 is an end view of a shim 86 which may be disposed within orifices 48 and 50 (see FIG. 2); and FIG. 10 is a side view of shim 86. As will be apparent to those skilled in the art, ski poles, such as ski pole 18, come in a variety of diameters, generally varying from about 0.515" to about 0.750 in diameter. The locking device 10 is preferably equipped with a multiplicity of shims 86 of varying internal diameters. In one embodiment, the internal diameter 88 is from about 0.515" to about 0.560", and the external diameter 90 of shim 86 is preferably about 0.750 inches. The length 92 of shim(s) 86 is generally from about 2.4 to about 2.5 inches.

Figure 11:
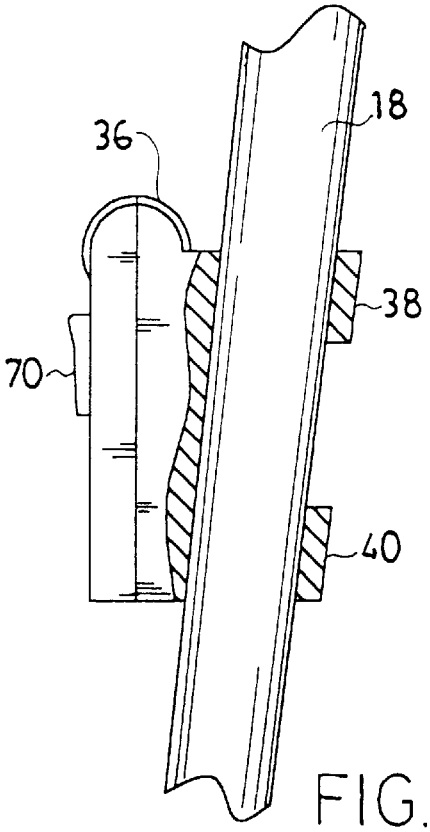
FIG. 11 is a sectional view of a ski pole disposed within the brackets of the locking device of FIG. 1 without a shim.
Figure 12:
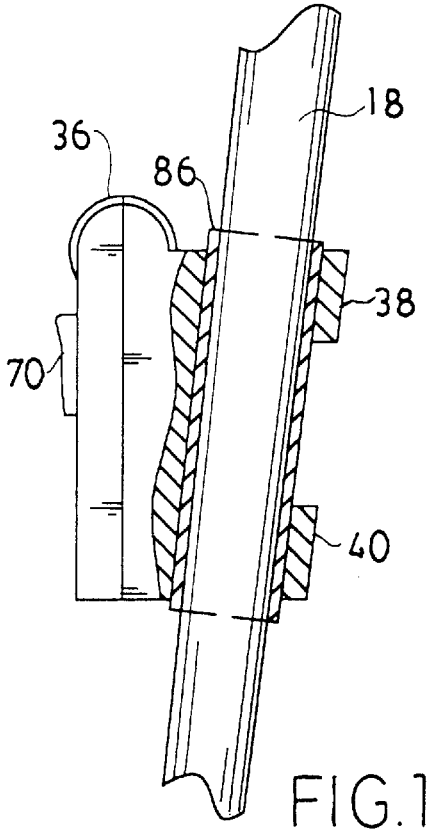
FIG. 12 is a sectional view of the a ski pole disposed within the shim of FIG. 9 which, in turn, is disposed within the brackets of the locking device of FIG. 1.

FIG. 11 illustrates an embodiment wherein shim 86 is not disposed within orifices 48 and 50, whereas FIG. 12 illustrates an embodiment wherein shim 86 is so disposed within orifices 48 and 50.

Figure 13:
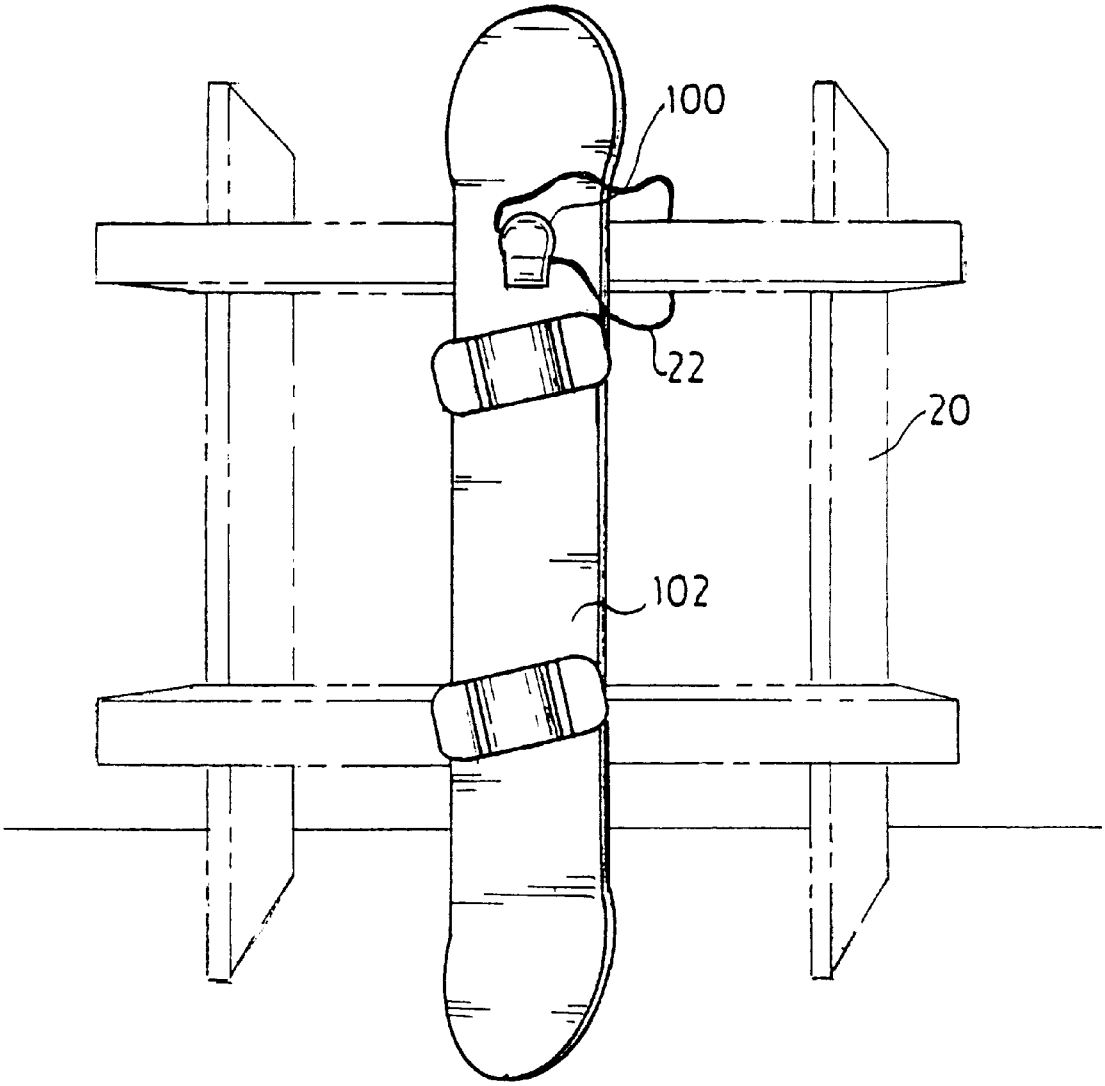
FIG. 13 is a perspective view of another locking device of this invention securing a snowboard to a stand.

FIG. 13 is a perspective view of another locking device 100 being used to secure a snowboard 102 to stand 20. As is known to those skilled in the art, a snowboard is a generally long structure in the shape of a plate, generally flat, whose thickness is approximately constant. Reference may be had, e.g., to U.S. Pat. Nos. 5,998,668, 5,988,470, 5,984, 757, 5,984,346, 5,984,343, 5,984,325, 5,983,529, 5,980,602, 5,979,726, 5,979,080, 5,975,557, 5,975,556, 5,975,554, 5,975,546, 5,975,229, 5,971,423, 5,967,542, 5,966,844, and the like. The disclosure of each of these United States patents is hereby incorporated by reference into this specification.

Referring again to FIG. 13, and in the preferred embodiment depicted therein, it will be seen that snowboard 102 is comprised of a first retention element 103, and a second retention element 105, both of which are adapted to a snowboarder's ("surfer's) boots in support on the base structure 107 of the snowboard 102.

Referring again to FIG. 13, it will be seen that locking device 100 is mounted on base structure 107 in the front half of the snowboard. However, as will be apparent to those skilled in the art, the locking device 100 can be mounted substantially in any position on snowboard 102 and its base structure 107. It is preferred that the locking device 100 be suitably mounted so that the cable 22 can be wrapped around a post 20.

Figure 14:
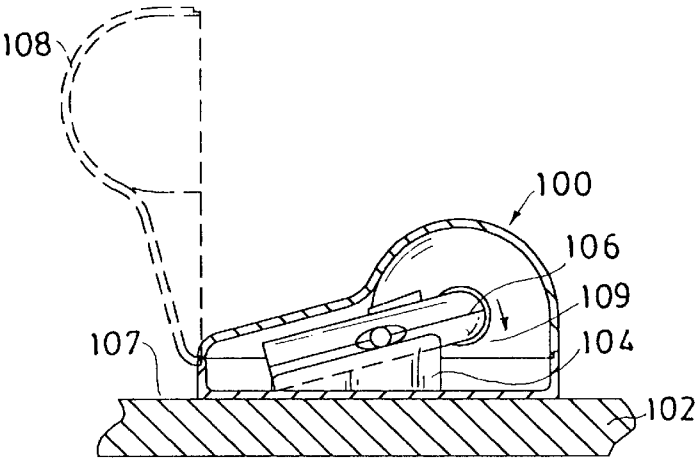
FIG. 14 is a side view of the locking device of FIG. 13 connected to such snowboard.

FIG. 14 is a side sectional view of the locking device 100 attached to snowboard 102. Any conventional attachment means may be used to secure the locking device 100 to the snowboard 102. By way of illustration and not limitation, one may use adhesive attachment means such as, e.g., "VHB ACRYLIC FOAM TAPE" sold by the Minnesota Mining and Manufacturing Corporation of Minneapolis, Minn. as product number VHB4941.

In one embodiment, any of the commonly available double-stick tapes may be used to secure the locking assembly 100 to the snowboard. Thus, e.g., one may use product number 4956 of the Minnesota Mining and Manufacturing Corporation which is identified as "Double Linered Loose Pieces."

Referring again to FIG. 14, and in the preferred embodiment depicted therein, it will be seen that a ramped shelf 104 is attached to the snowboard 102 by means of base 110. and, mounted therein is a cable lock assembly 106 which is substantially identical to the lock assembly 10 but differs therefrom in not containing the body 42 and the brackets 38 and 40. The lock assembly 106 is substantially identical to the "KRYTPONITE" combination lock with retractable cable which is referred to elsewhere in this specification.

The ramped shelf is configured that cable lock assembly 106 is disposed at an angle 109 with regard to base 110 of from about 5 to about 20 degrees and, more preferably, from about 8 to about 15 degrees. This geometric relationship insures ready visual and tactile access to the tumblers 32, 34, and 36 and allows for cover 108 to have an aerodynamic profile with minimal wind resistance.

In one embodiment, illustrated in FIG. 14, each of base 110, ramped shelf 104, and cable lock assembly 106 are integrally connected to each other.

In one embodiment, not shown, adhesive means are used to secure lock assembly 106 to ramped shelf 104. In another embodiment, not shown, a screw is used to secure lock assembly 106 to ramped shelf 104.

In the preferred embodiment depicted in FIG. 14, ramped shelf 104 is integrally and hingeably attached to cover 108 and base 110. As will be apparent to those skilled in the art, this arrangement prevents the entry of snow and other contaminants into the locking device but facilitates easy entry thereto whenever necessary.

Figure 14A:
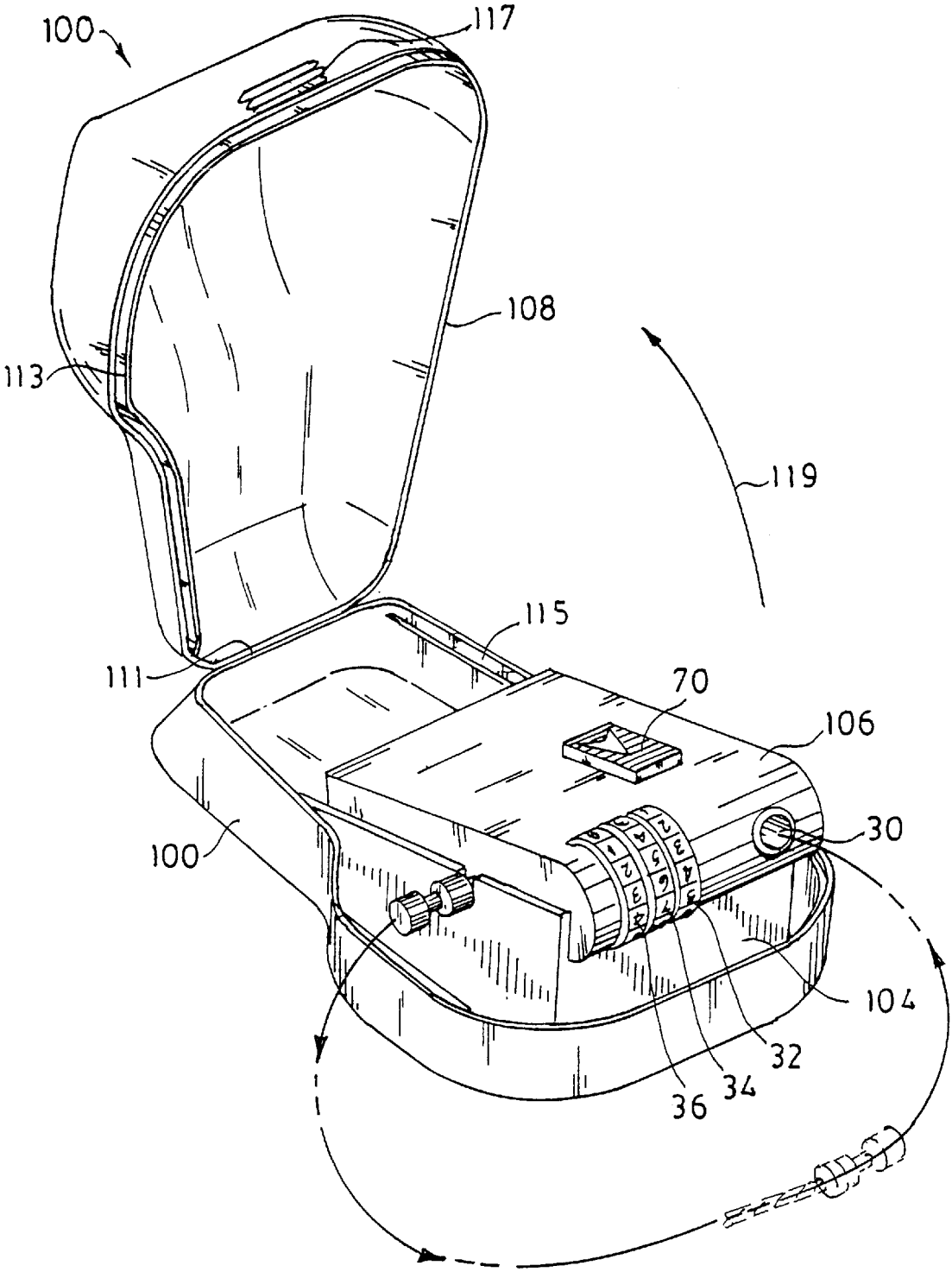
FIG. 14*a* is a perspective view of the locking assembly 100 depicted in FIG. 14.

One may use any conventional means for hingeably attaching cover 108 to base 110. In one embodiment, illustrated in FIG. 14*a*, a live hinge 111 is used to providing such attachment means. As is known to those skilled in the art, a live hinge is a device which is usually integrally molded with a body as a unitary physical structure. Reference may be had, e.g., to U.S. Pat. Nos. 5,988,429, 5,855,272, 5,842,806, 5,785,399, 5,676,306, and the like. The entire disclosure of each of these United States patents is hereby incorporated by reference into this specification.

Referring again to FIG. 14*a*, it will be seen that, in the preferred embodiment depicted therein, means are provided for removably locking cover 108 to base 110. In the preferred embodiment illustrated, these means comprise a male lip 113 adapted to engage with a female lip 115 and to removably secure cover 108 to base 110. When so secured, the cover 108 and the base 110 provide a weatherproof seal protecting against the elements. When a user desires to disengage cover 108 from base 110, he may apply pressure with a finger on ridges 117 in the direction of arrow 119.

Figure 15:
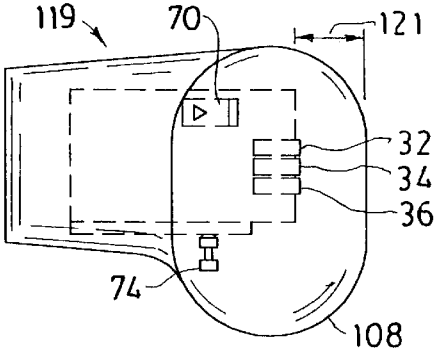
FIG. 15 is a top view of the locking device of FIG. 14.

FIG. 15 is a top view of the assembly of FIG. 14, showing it in its closed position. It will be seen that, in the preferred embodiment depicted, the combination of cover 108 and base 110, in its closed position, forms a enclosure 119 which is substantially pear shaped. Although other aerodynamic shapes also may be used, what is important is that such shape not have any sharp, wind-resistant edges or surfaces. The absence of sharp edges also minimizes the risk of injury to the snowboarder.

Referring again to FIG. 15, and in the preferred embodiment depicted therein, it will be seen that the distance 121 between the front of tumblers 32, 34, and 36 and the edge 123 formed by the intersection of cover 108 and base 110 is preferably at least about 0.4 inches. In one embodiment, distance 121 is preferably from about 0.4 to about 0.8 inches.

Figure 16:
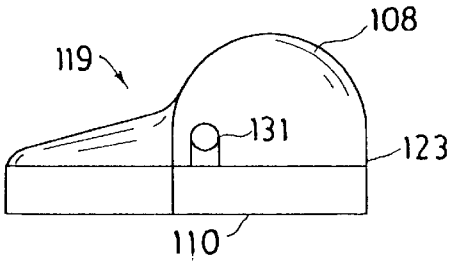
FIG. 16 is a right side view of the locking device of FIG. 14.

FIG. 16 is a side view of the assembly of FIG. 15, from which detail of the locking device 106 has been omitted for the sake of simplicity of representation. Referring to FIG. 16, it will be seen that orifice 131 is formed between cover 108 and base 110 and is adapted to receive a cable (not shown in FIG. 16, but see FIG. 8 and cable 22).

Figure 17:
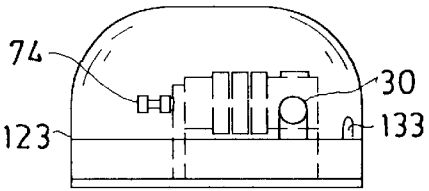
FIG. 17 is a front view of the locking device of FIG. 14.

FIG. 17 is a front schematic view of the device of FIG. 14. An orifice 133 is formed between cover 108 and base 110 and is adapted to receive a cable (not shown in FIG. 16, but see FIG. 8 and cable 22).

Figure 18:
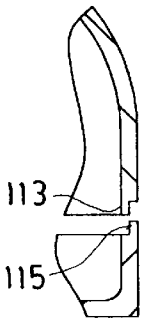
FIG. 18 is an enlarged sectional view of a portion of the device depicted in FIG. 17.

FIG. 18 is partial sectional view of the device of FIG. 14, illustrating how lips 113 and 115 interlockably engage each other when cover 108 is closed.

Figure 19:
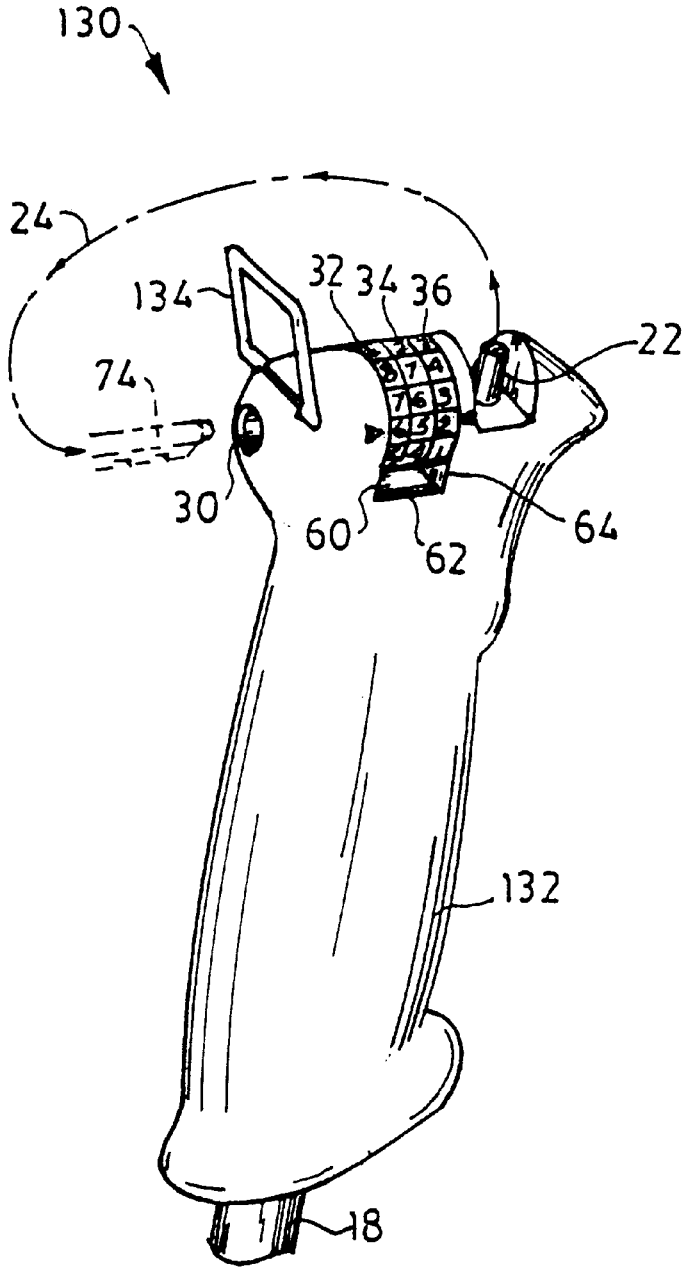
FIG. 19 is a perspective view of another preferred locking device of the invention.
Figure 21:
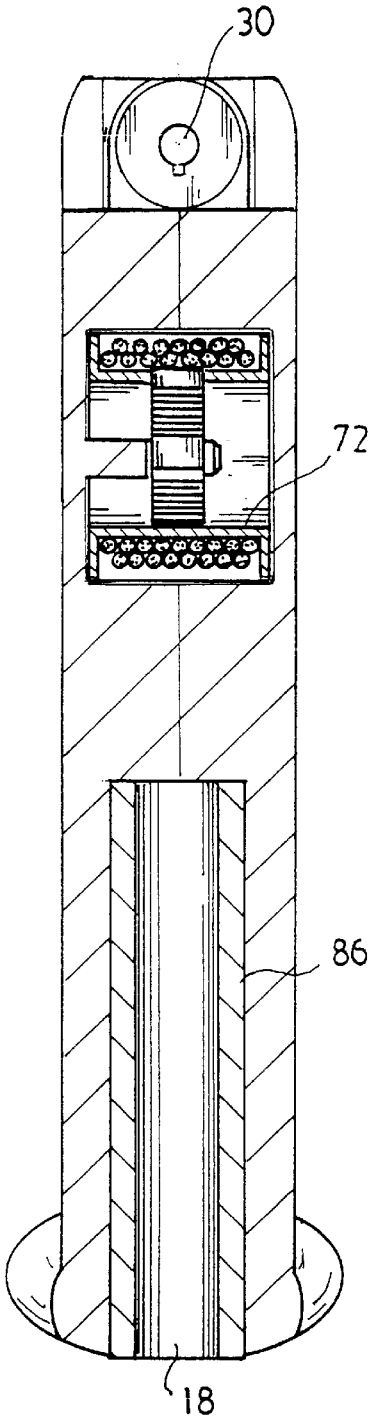
FIG. 21 is a front sectional view of the device of FIG. 19.

FIG. 19 is a perspective view of another locking device 130 which functions in a manner similar to that of the device depicted in FIGS. 1 and 21 and has many of the same components such as, e.g., a barrel tumbler locking mechanism with a retactrable cable. As will be apparent to those skilled in the art, the device 130 differs from the device 10 in that the former device is comprised of a handle body 132 with an orifice (not shown) adapted to receive pole 18. By comparison, the body 42 of the device of FIG. 2 is attached to brackets 38 and 40, which brackets receive the ski pole 18. Otherwise, these devices are similar in structure and operation.

Referring to FIG. 19, it will be seen that, in the preferred embodiment depicted, body 132 is attached to a clip 134.

Figure 20:
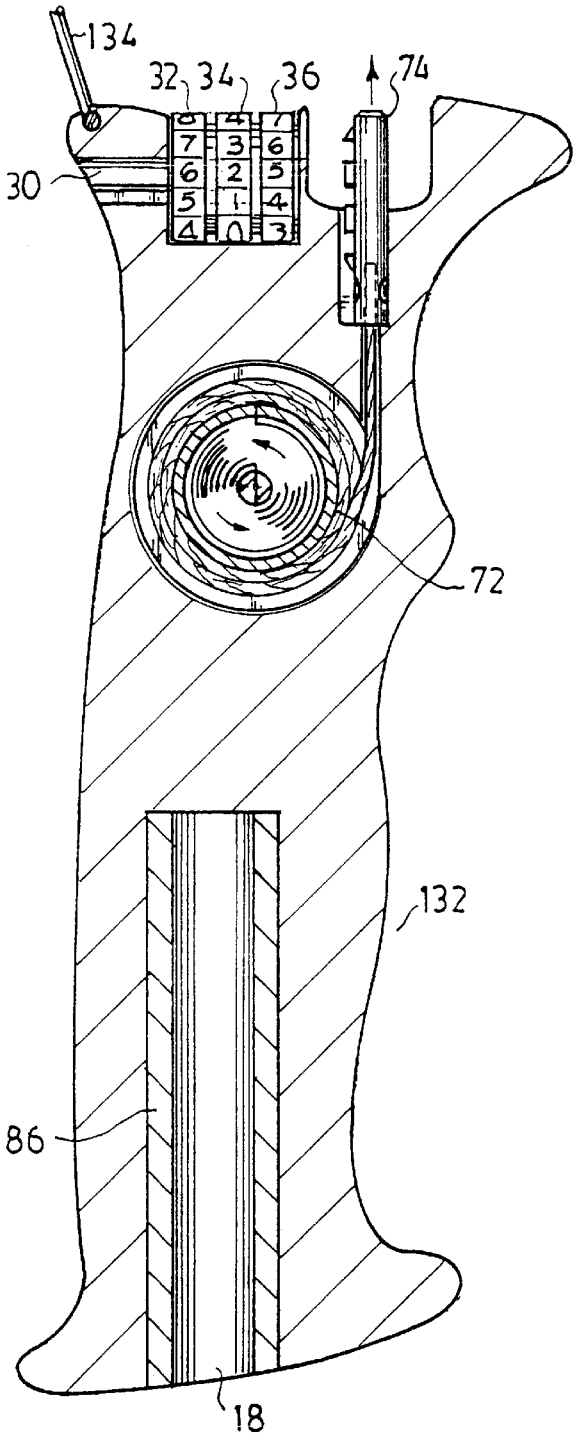
FIG. 20 is a side sectional view of the device of FIG. 19.

FIG. 20 is a sectional view of the device of FIG. 19. As will be apparent, the reel device 72 of FIGS. 20 and 21 operates in substantially the same manner as the reel device 72 of FIG. 8.

Referring to FIG. 20, and in the preferred embodiment depicted therein, it will be seen that a shim is being used to securely attach ski pole 18 within the body 132.

Figure 22:
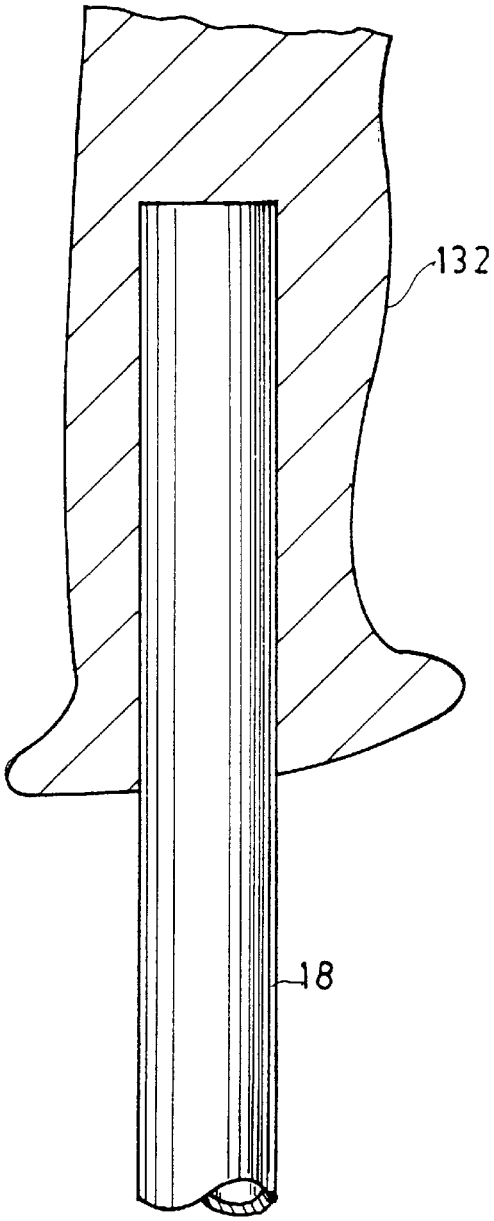
FIG. 22 is a partial sectional view of the device of FIG. 19, illustrating a ski pole disposed within such device without the use of a shim.
Figure 23:
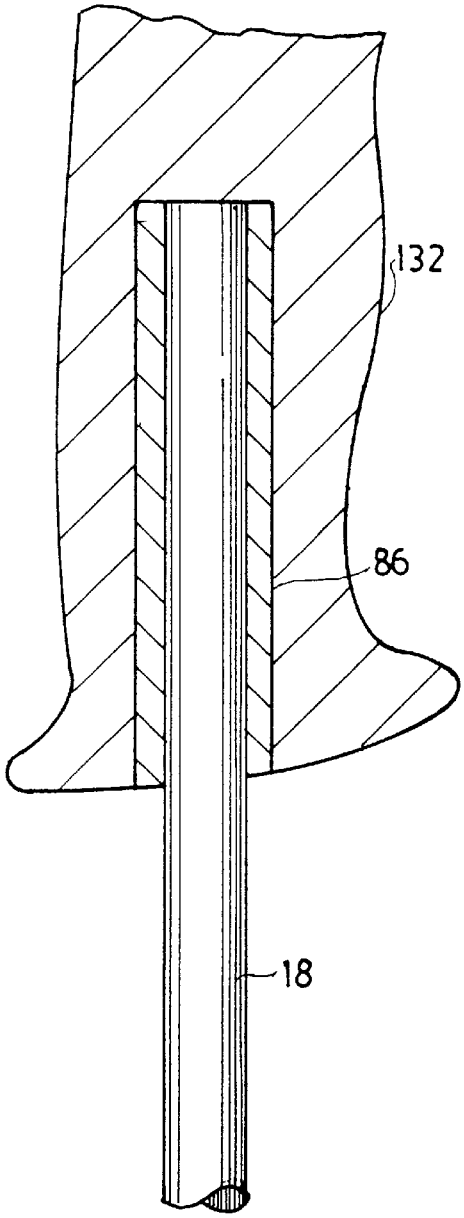
FIG. 23 is a partial sectional view of the device of FIG. 19, illustrating a ski pole disposed within such device with the use of a shim.

FIGS. 22 and 23 are partial sectional views which illustrate how the device of FIG. 20 can be used without a shim (FIG. 22) and with a shim (FIG. 23).

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A snowboard assembly comprised of a snowboard attached to a locking assembly, wherein:

(a) said snowboard is a comprised of a base portion and a first retention element attached to said base, (b) said locking assembly is comprised of an enclosure and, disposed therein, a locking device, wherein:

1. said enclosure is comprised of a base, a cover hingeably attached to said base, and means for removably locking said cover to said base, 2. a ramped shelf is connected to said base,
3. said locking device is attached to said ramped shelf and is so disposed with respect to said base that it forms an angle of from about 5 to about 20 degrees with respect to such base, and
4. said locking device comprises a body connected to a combination lock with a retractable cable.

2. The snowboard assembly as recited in claim 1, wherein said snowboard is comprised of a second retention element attached to said base portion.

3. The snowboard assembly as recited in claim 2, wherein said ramped shelf is comprised of an upper inclined surface.

4. The snowboard assembly as recited in claim 3, wherein said base is connected to said upper inclined surface.

5. The snowboard assembly as recited in claim 4, wherein said base is integrally connected to said upper inclined surface.

6. The snowboard assembly as recited in claim 5, wherein said base is hingeably attached to said cover by means of a live hinge attached to said base and said cover.

7. The snowboard assembly as recited in claim 6, wherein said live hinge is integrally attached to said base and said cover.

8. The snowboard assembly as recited in claim 7, wherein said locking device is comprised of a first tumbler, a second tumbler, and a third tumbler.

9. The snowboard assembly as recited in claim 8, wherein said snowboard is in the shape of a generally flat palte with a substantially constant thickness.

10. The snowboard assembly as recited in claim 8, wherein said locking assembly is adapted to be adhesively attached to said snowboard by means of double sided tape.

11. The snowboard assembly as recited in claim 10 wherein, when said cover is removably locked to said base, an enclosure is formed which includes a first orifice.

12. The snowboard assembly as recited in claim 11 wherein, when said cover is removably locked to said base, an enclosure is formed which includes a second orifice.

* * * * *